US005588852A

United States Patent [19]

Puerner

[11] Patent Number: 5,588,852

[45] Date of Patent: Dec. 31, 1996

[54] ELECTRICAL CONNECTOR HAVING SOCKET CONTACTS WITH SAFETY SHIELDS

[75] Inventor: Dean A. Puerner, Maricopa, Ariz.

[73] Assignee: The Whitaker Corporation, Wilmington, Del.

[21] Appl. No.: 408,050

[22] Filed: Mar. 21, 1995

[51] Int. Cl.[6] ..... H01R 13/44; H01R 13/187

[52] U.S. Cl. ..... 439/135; 439/752; 439/843; 439/851

[58] Field of Search ..... 439/133–135, 439/752, 843, 911, 851

[56] References Cited

U.S. PATENT DOCUMENTS

| | | | |
|---|---|---|---|
| 3,059,208 | 12/1960 | Concelman | 339/65 |
| 4,572,606 | 2/1986 | Neumann et al. | 339/262 R |
| 4,693,002 | 9/1987 | Neumann et al. | 29/882 |
| 4,714,441 | 12/1987 | Corman | 439/842 |
| 4,749,357 | 6/1988 | Foley | 429/80 |
| 4,772,231 | 9/1988 | Hayes | 439/752 |
| 5,362,261 | 11/1994 | Puerner | 439/752 |

FOREIGN PATENT DOCUMENTS

| | | | |
|---|---|---|---|
| 495705 | 7/1992 | European Pat. Off. . | |
| 577235 | 9/1924 | France . | |
| 2588424 | 4/1987 | France . | |
| 497612 | 5/1930 | Germany . | |
| 1331301 | 9/1973 | United Kingdom | 439/135 |
| 2187895 | 9/1987 | United Kingdom . | |

*Primary Examiner*—Steven C. Bishop
*Attorney, Agent, or Firm*—Robert J. Kapalka

[57] ABSTRACT

An electrical plug connector for an electrical connector assembly comprises a dielectric housing having at least one cavity which extends inwardly from a mating face of the housing. An electrically conductive socket contact is disposed in the at least one cavity. The socket contact has a generally tubular shape with inner and outer surfaces and an end face which is disposed in a vicinity of the mating face. A first dielectric member is disposed on the socket contact and extends at least over the end face so as to shield the socket contact from inadvertent electrical engagement. For a socket contact of relatively large diameter, a second dielectric member having a post may be disposed centrally within the socket contact to prevent inadvertent engagement with the inner surface thereof.

8 Claims, 7 Drawing Sheets

ELECTRICAL CONNECTOR HAVING SOCKET CONTACTS WITH SAFETY SHIELDS

FIELD OF THE INVENTION

The invention relates to an electrical plug connector having socket contacts with individual safety shields which prevent inadvertent electrical engagement of the socket contacts.

BACKGROUND OF THE INVENTION

Today's sophisticated electronic equipment often requires electrical interconnections for multiple levels of power and numerous sense and signal lines to operate and communicate among the various equipment and sub-assemblies within the entire system. A fairly common requirement for a pluggable power supply entails a primary power input rated at up to 35 amperes, a low voltage dc output capable of 150–200 amperes, a secondary low voltage output capability for perhaps 15 amperes, and a communications and control interface with 30, 40, or more sense and signal lines. Rather than use a variety of connectors, it is highly desirable to use a single hybrid connector having a plurality of different sized electrical terminals, each size being capable of carrying a different level of power, and such hybrid connectors are known. One type of electrical terminal for a hybrid connector is a pin and socket terminal wherein an elongated pin contact is receivable within a tubular socket contact, and it is common for the socket contact to include an internal louvered metal band which is effective for transmitting high levels of power. With hybrid connectors, the pins and sockets for the different power levels need to be connected sequentially beginning with the highest power level so that stray voltage spikes are not induced in the lower power level lines. This is accomplished with pins of different lengths, each length being associated with a specific power level, whereby the different length pins engage their corresponding sockets at different times during coupling of the connector. A problem arises in that the different length pins result in an increased length for the connector.

Connectors carrying power also must meet certain safety requirements. In today's global market, it is also desirable that connectors be able to meet international as well as national safety standards promulgated by, for example, the Underwriters' Laboratories (UL), the International Electrotechnical Commission (IEC), and the Verein Deutscher Electrotechnischie (VDE). One particular VDE standard that must be met is that the connector must be designed so that an articulate test probe having a precise shape cannot be inserted into the connector to engage a power contact therein. A simple way to meet this standard is to recess each contact at a suitable depth within its cavity in the connector so that the test probe, which is generally wider than the cavity, cannot engage the contact. However, recessing the contact increases the length of the connector. There is a need for a connector design which is suitable for hybrid connector applications and which will meet test probe safety standards while permitting a reduction in connector size.

SUMMARY OF THE INVENTION

It is an object of the invention to provide an electrical connector for carrying elevated power levels.

It is another object of the invention to provide an electrical connector which meets test probe safety standard criteria.

It is a further object of the invention to reduce the size of an electrical connector.

These and other objects are accomplished by an electrical plug connector according to the invention which is matable with a receptacle connector to form an electrical connector assembly. The plug connector comprises a dielectric housing having at least one cavity which extends inwardly from a mating face of the housing. An electrically conductive socket contact is disposed in the at least one cavity. The socket contact has a generally tubular shape with inner and outer surfaces and has a contact section adapted for mating with a corresponding pin contact of the receptacle connector. The contact section has an end face disposed in a vicinity of the mating face. A first dielectric member is disposed on the socket contact and extends at least over the end face of the socket contact so that inadvertent electrical engagement with the socket contact is prevented. For a socket contact of relatively large diameter, a second dielectric member having a post may be disposed centrally within the socket contact to prevent inadvertent engagement with the inner surface thereof.

BRIEF DESCRIPTION OF THE DRAWINGS

The invention will now be described by way of example with reference to the accompanying drawings in which like elements in different figures thereof are identified by the same reference numeral and wherein.

DESCRIPTION OF THE PREFERRED EMBODIMENT

Figure 1:
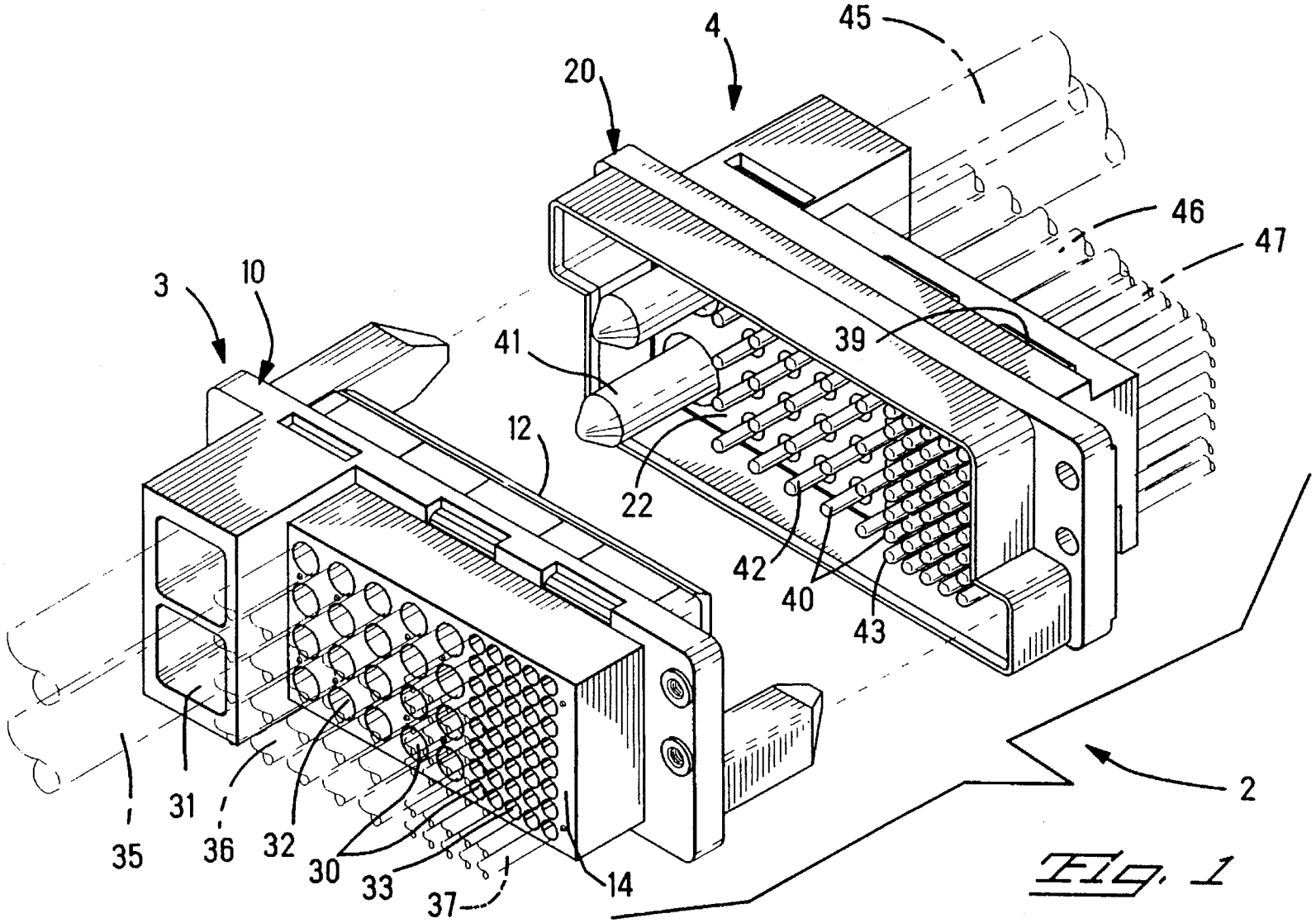
FIG. 1 is a perspective view of a matable connector assembly having pin and socket contacts with cable shown in phantom.

There is shown in FIG. 1 a hybrid electrical connector assembly 2 including a plug connector 3 and a receptacle connector 4. Each of the connectors 3, 4 includes a dielectric housing 10, 20, respectively, having a mating face 12, 22, respectively. The plug connector 3 has a plurality of cavities 30 extending therethrough from the mating face 12 to an opposite remote face 14 of the housing. The cavities 30, which are of different sizes and shapes to accommodate different sizes and shapes of electrical contacts associated with different power levels, are arrayed in a first group 31, a second group 32 and a third group 33, with the cavities in each group having a common size and shape. Within each of the cavities 30 is an appropriately sized socket contact which is terminated to an electrical conductor such as an insulated wire cable 35, 36, 37 as shown in phantom in the drawings. The receptacle connector 4 has a plurality of cavities each of which houses a pin contact 40, and the pin contacts are arrayed in three groups 41, 42, 43 corresponding to the groups of cavities 31, 32, 33 in the plug connector. The pin contacts 40 are terminated to respective electrical conductors such as insulated wire cables 45, 46, 47 which are shown in phantom.

Figure 2:
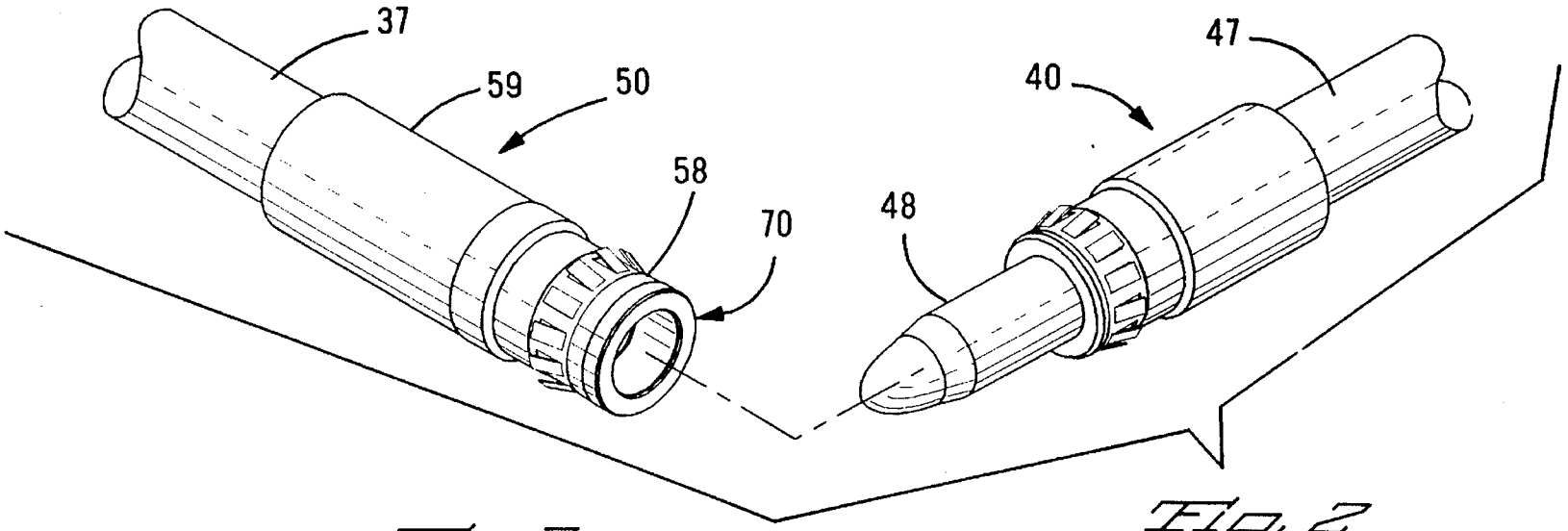
FIG. 2 is a perspective view of pin and socket contacts used in the connector assembly.
Figure 3:
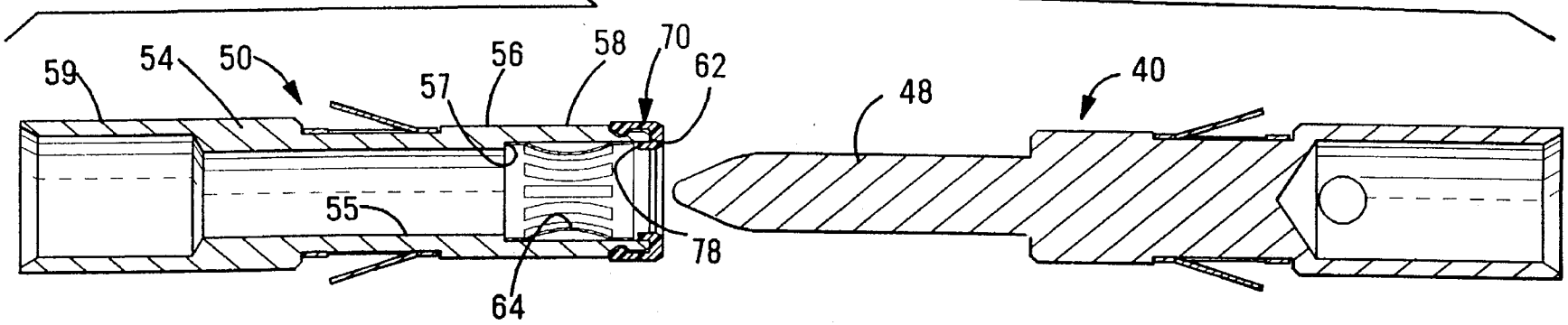
FIG. 3 is a cross-sectional view of the pin and socket contacts.

Referring to FIGS. 2 and 3, a representative socket contact 50 for use in the plug connector 3 comprises an electrically conductive socket body 54 which is generally tubular in shape with an inner surface 55, an outer surface 56, and an end face 62. At one end the socket contact 50 has a female contact section 58 which is adapted for mating with a corresponding male contact section 48 of the pin contact 40 of the receptacle connector. At the other end the socket contact 50 has a termination section 59 which is adapted for termination to an electrical conductor. In the present example the termination section 59 is a barrel element which is crimped to the cable 37, although the termination section 59 may be a solder tail which is soldered in a hole of a circuit board. A first dielectric member 70 is disposed on the contact section 58. A known type of louvered metal band 64 which is favored for conducting relatively high power levels is preferably disposed in the contact section 58 inward of the end face 62.

Figure 4:
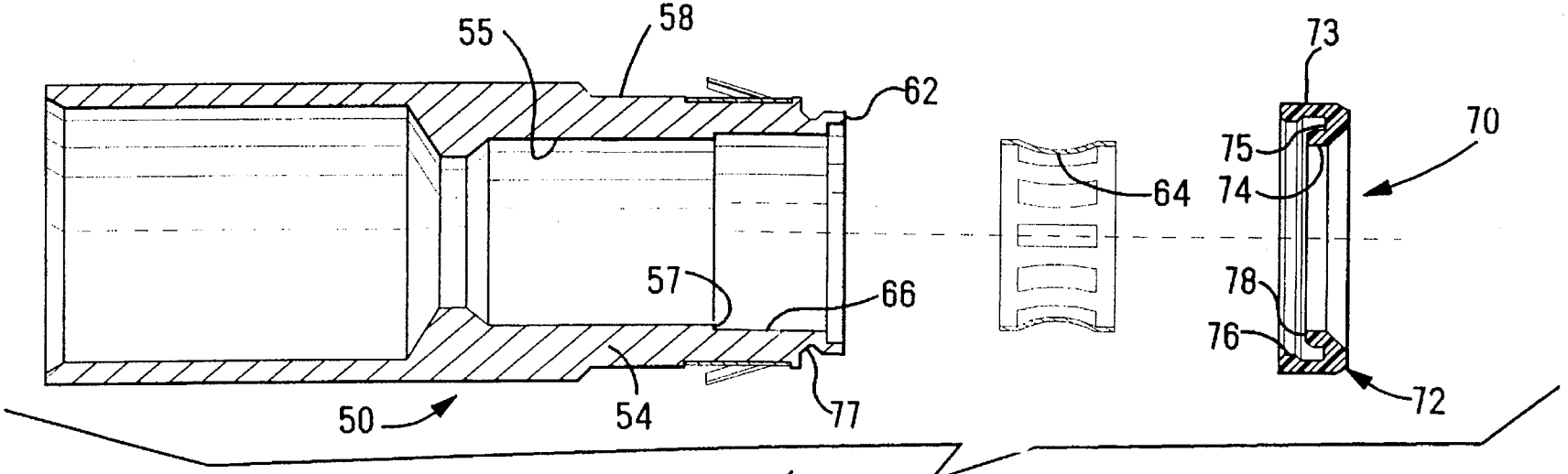
FIG. 4 is an exploded cross-sectional view of the socket contact with a dielectric cap.

According to the invention the first dielectric member 70 extends at least over the end face 62 of the socket contact 50, and preferably extends axially for a short distance over both the inner and outer surfaces 55, 56. In one embodiment as shown in FIGS. 3 and 4, the first dielectric member is a cap 72 which is ring-shaped and is made from a plastic or other pliable insulative material. The cap 72 has an annular outer portion 73 which is connected to an annular inner portion 74. Between the outer and inner portions 73, 74 is a groove 75 that is dimensioned to receive an end portion of the contact section 58 adjacent to the end face 62. The cap 72 is retained on the contact section 58 by a snap fit means such as an interengaging ridge 76 and groove 77 defined by the cap 72 and the socket body 54. The inner portion 74 is preferably dimensioned to provide an edge 78 that prevents withdrawal of the metal band 64 from the socket contact in one axial direction. The metal band 64 is prevented from moving in the other axial direction by a lip 57 which is formed by an undercut 66 on the inner surface 55 of the socket body 54. The edge 78 eliminates the need for a second lip or other retention feature which would normally by machined or formed along the inner surface of the socket body 54, thereby reducing manufacturing expense for the socket body 54. Also, the metal band 64 can now be installed along a smooth surface up to the lip 57, thereby easing installation and removal of the metal band 64 from the socket contact.

Figure 5:
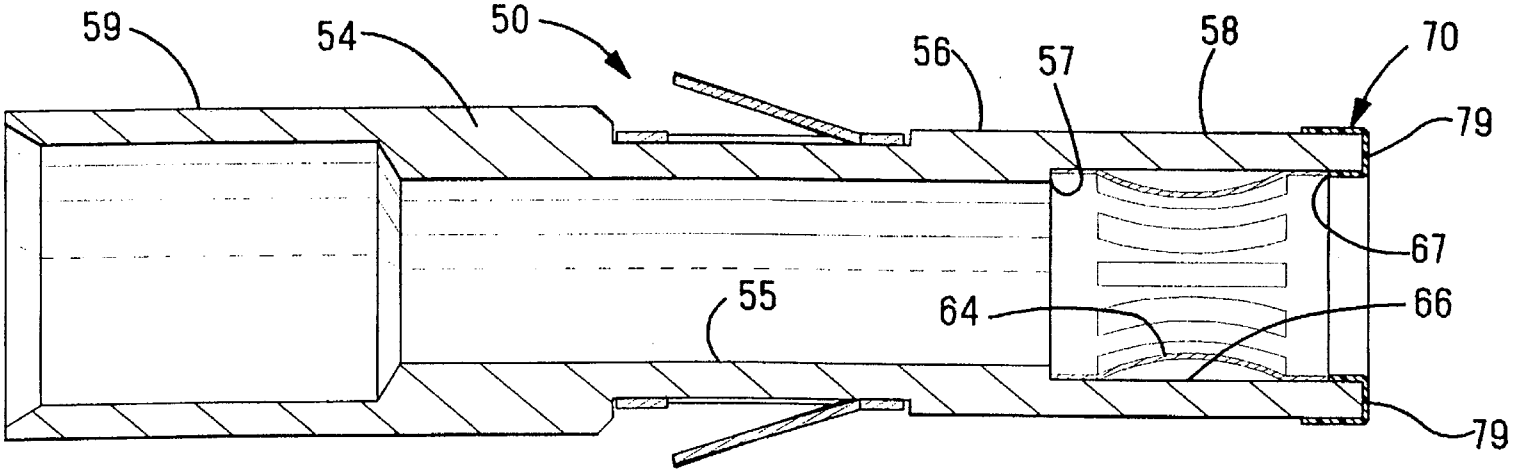
FIG. 5 is a cross-sectional view of the socket contact with a dielectric coating.

In an alternate embodiment as shown in FIG. 5, the first dielectric member 70 is simply a coating 79 of insulative material over the end portion of the contact section 58. In this embodiment the undercut 66 extends to a second lip 67 which cooperates with the lip 57 to retain the metal band 64 in the socket.

Figure 6:
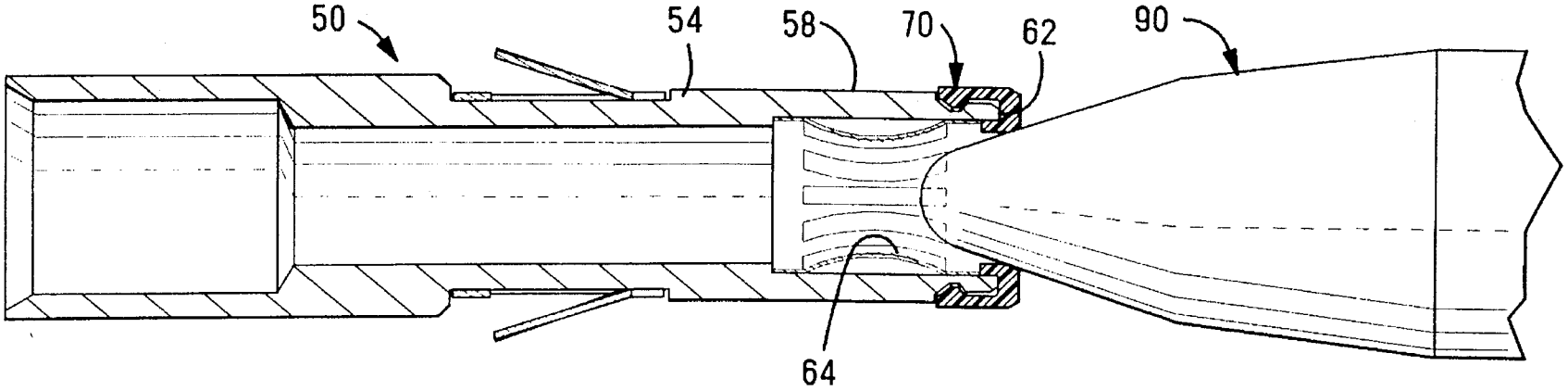
FIG. 6 is a cross-sectional view of a safety test probe being inserted into the socket contact.

FIG. 6 illustrates how the invention satisfies finger probe test requirements. A VDE standard test probe 90 cannot be inserted into a socket contact of relatively small size, i.e., having an internal diameter of 6mm or less. The first dielectric member 70 acts as a shield to prevent inadvertent electrical engagement with the contact body 54 at or near the end face 62.

For socket contacts having an internal diameter greater than 6 mm, the metal band can be disposed axially further in the socket from the end face 62, and the dielectric member 70 can be configured to extend axially further along the inner wall of the contact section 58 by a corresponding amount.

Figure 7:
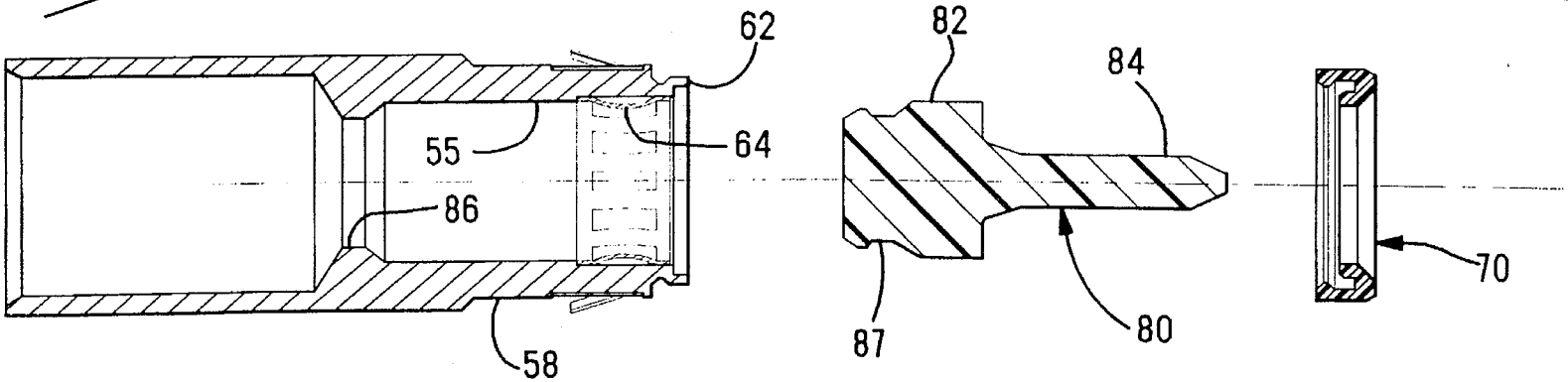
FIG. 7 is a cross-sectional view of the socket contact in another embodiment.
Figure 8:
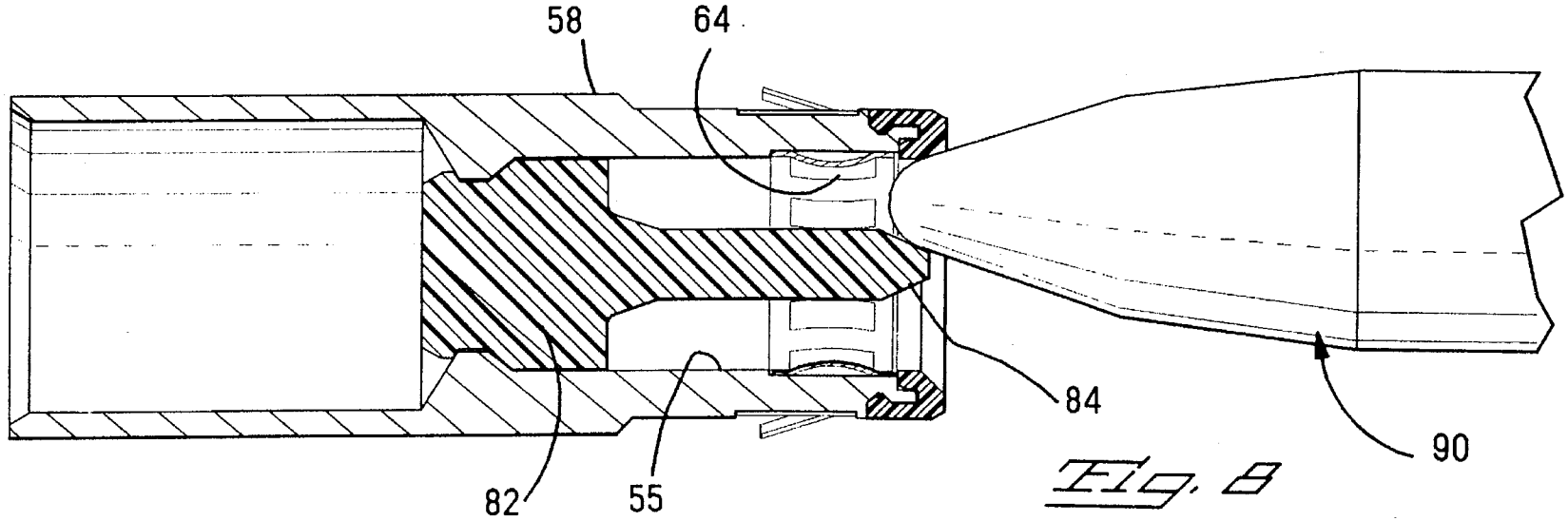
FIG. 8 is a cross-sectional view of a safety test probe being inserted into the socket contact of FIG. 7.
Figure 9:
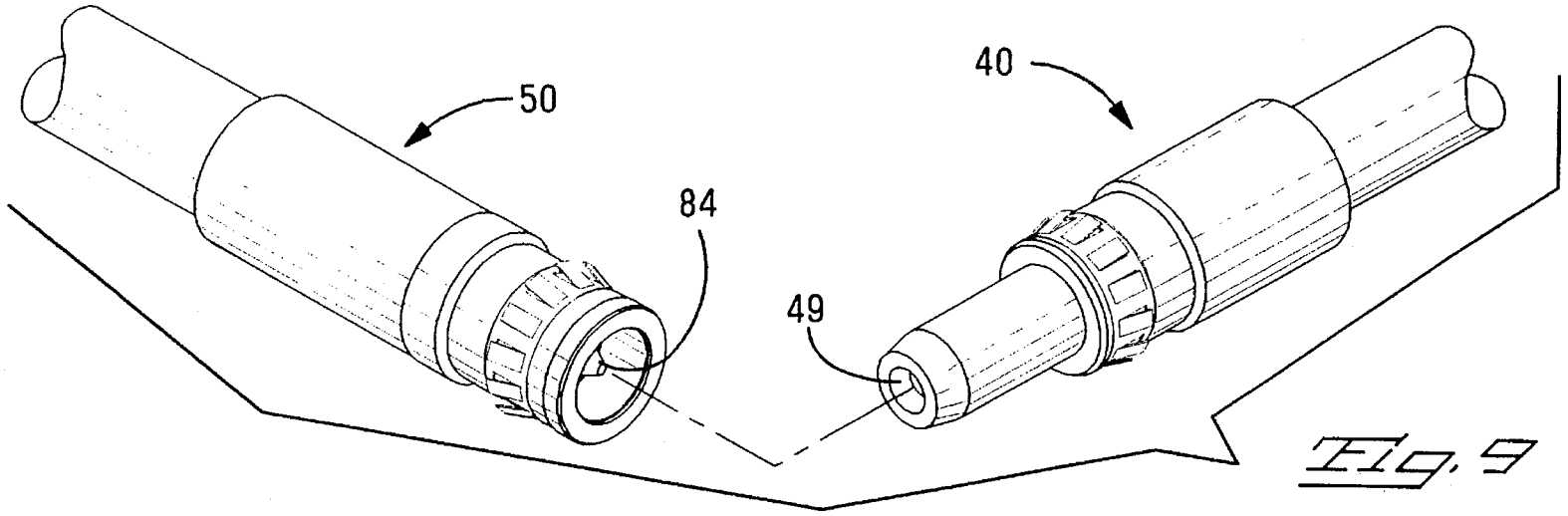
FIG. 9 is a perspective view of the socket contact of FIG. 7 with a mating pin contact.

In order to satisfy safety test requirements for relatively large socket contacts, i.e., 9 mm internal diameter and above, a second dielectric member may be disposed within the contact section of the socket contact. As shown in FIGS. 7 and 8, a second dielectric member 80 includes a base 82 and a post 84. The member 80 is retained in the socket contact by a snap fit means such as interengaging ridge 86 and groove 87. The post 84 is dimensioned so that an annular space between the post 84 and the inner surface 55 of the contact section 58 is sufficiently small to prevent insertion of the VDE standard test probe 90. As shown in FIG. 9, the mating pin contact 40 of the receptacle connector has a contact section with a central cavity 49 which is dimensioned to receive the post 84.

Figure 10:
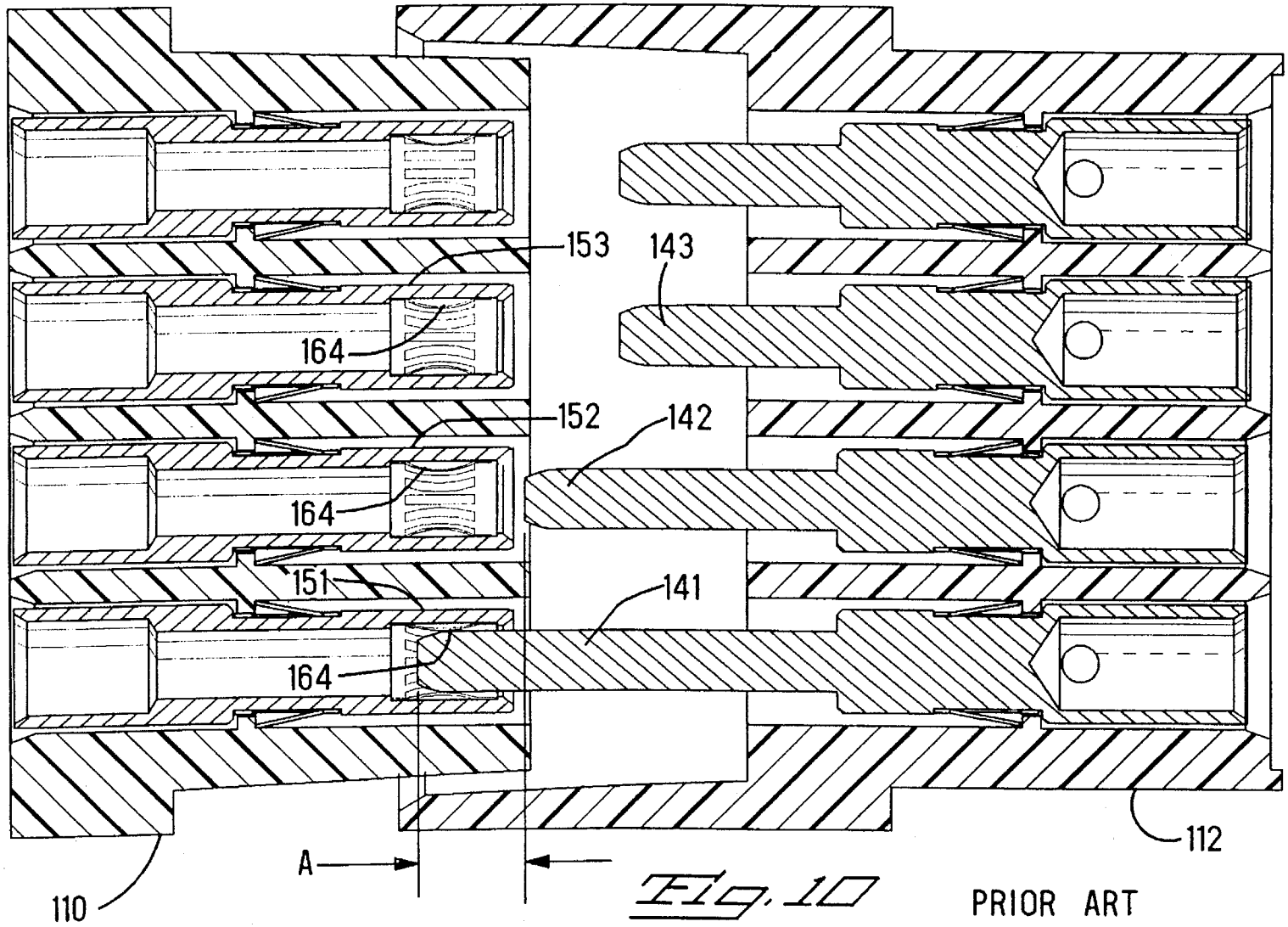
PRIOR ART FIG. 10
FIG. 10 is a cross-sectional view of an exemplary prior art connector assembly.

Reference will now be made to an illustration of a prior art connector in order to explain a further advantage of the invention. There is shown in FIG. 10 a cross-sectional view of an exemplary prior art hybrid electrical connector which does not have either the first or second dielectric members. The hybrid electrical connector includes a plug connector having a housing 110 and socket contacts 151, 152, 153 each with a metal band 164, and a receptacle connector having a housing 112 and pin contacts 141, 142, 143 of different lengths. In order to ensure that the mating contacts 141, 151 will electrically engage before the mating contacts 142, 152, it is necessary that the pin contact 141 extend beyond the pin contact 142 by a minimum dimension A. If the dimension A is shorter than the minimum, angular or axial misalignment of the mating contacts could cause the pin contact 142 to inadvertently engage its mating socket contact 152 at the end thereof before the pin contact 141 could be assured of engaging its mating socket contact 151.

Figure 11:
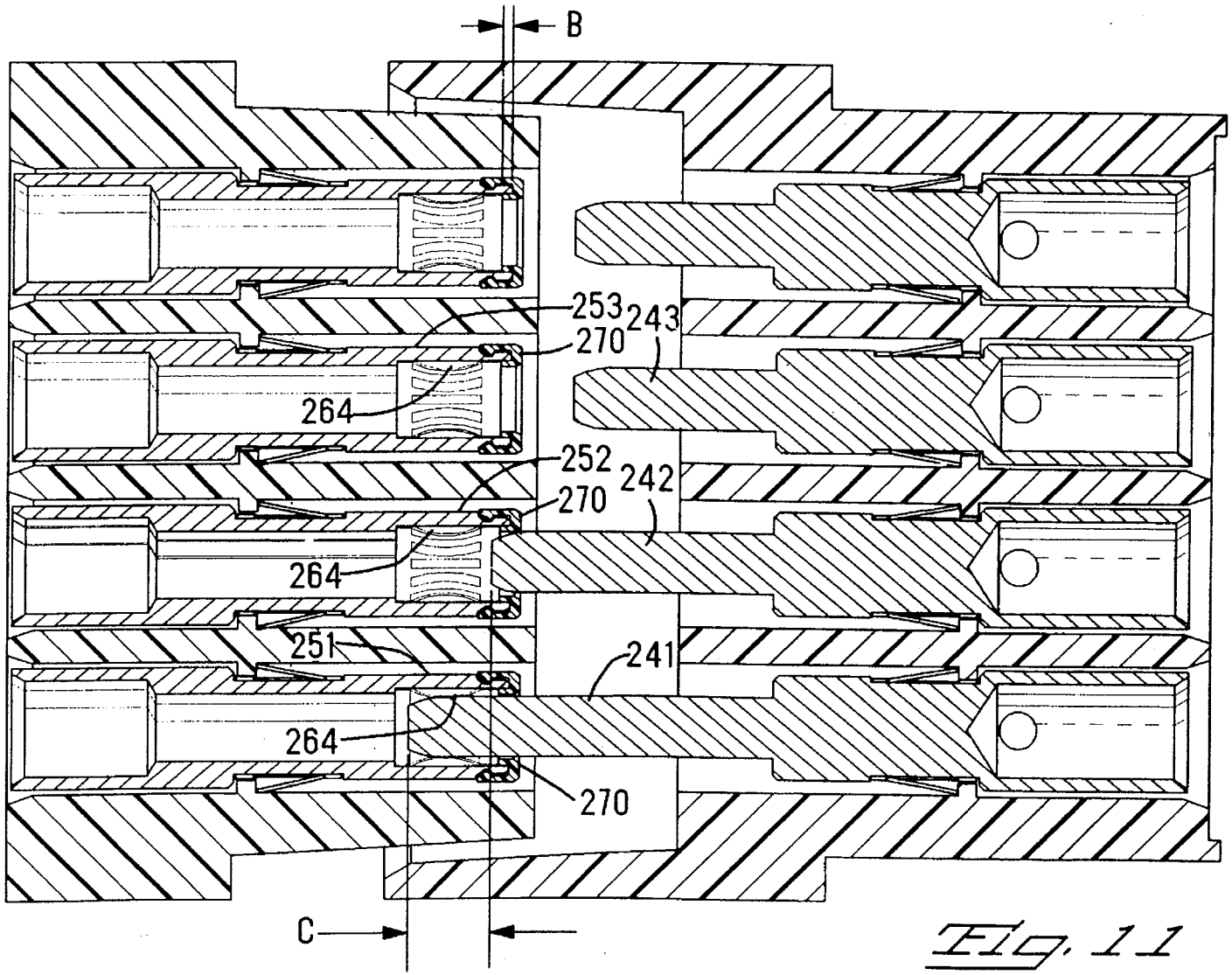
FIG. 11 is a cross-sectional view of an exemplary connector assembly according to the invention.

An advantage of the invention is that the dimension A is reduced compared to the prior art. As shown in FIG. 11, an exemplary hybrid electrical connector according to the invention has socket contacts 251, 252, 253 each with a metal band 264 and a first dielectric member 270. The first dielectric member 270 extends into each of the socket contacts by a dimension B. Since no electrical engagement between mating pin and socket contacts can occur along the socket contact portion corresponding to dimension B, a minimum dimension C between ends of the pin contacts 241 and 242 can be no greater than A minus B. In practice, the dimension C is somewhat less than A minus B because the metal band 264 is partially shielded by the first dielectric member 270 so that electrical engagement of mating pin and socket contacts cannot occur immediately beyond the axially inner end of the first dielectric member 270. Since the dimension C is less than the dimension A, a hybrid electrical connector according to the invention, having a number of pin and socket contact groups which must mate sequentially, can be reduced in length by several times the difference between A and C.

The invention provides a number of advantages. The first dielectric member shields the end of the socket contact, thereby preventing electrical engagement by a standard test probe. The first dielectric member can also prevent withdrawal of a louvered metal band from the socket contact, thereby eliminating an undercut on the inner surface of the socket contact. Finally, a hybrid connector can have pin contacts which differ in length by a lesser amount than is permitted by the prior art, thereby permitting a reduction in size of the hybrid connector, or an increase in the number of sequencing steps possible for a given size connector.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. A plug connector which is matable with a receptacle connector to form an electrical connector assembly, the plug connector comprising:

a dielectric housing having at least one cavity which extends inwardly from a mating face of the housing;

an electrically conductive socket contact disposed in the at least one cavity, the socket contact being generally tubular with inner and outer surfaces and having a contact section adapted for mating with a corresponding pin contact of the receptacle connector, the contact section having an end face disposed in a vicinity of the mating face;

a first dielectric member disposed on the socket contact and extending at least over the end face; and a second dielectric member disposed within the socket contact the second dielectric member having a post disposed in the contact section so as to define a gap between the post and the inner surface of the contact section;

wherein inadvertent electrical engagement with the socket contact is prevented.

2. The plug connector according to claim 1, wherein the first dielectric member is an insulative coating.

3. The plug connector according to claim 1, wherein the first dielectric member is an insulative cap which is retained on the socket contact by a snap fit means.

4. The plug connector according to claim 3, wherein the snap fit means includes an interengaging ridge and groove formed by the insulative cap and the socket contact.

5. The plug connector according to claim 3, further comprising a louvered metal band disposed within the contact section, and an edge of the insulative cap secures the louvered metal band against withdrawal in one direction.

6. The plug connector according to claim 1, is wherein the second dielectric mender includes a base which is retained in the socket contact by a snap fit means.

7. A plug connector which is matable with a receptacle connector to form an electrical connector assembly, the plug connector comprising:

a dielectric housing having at least one cavity which extends inwardly from a mating face of the housing;

an electrically conductive socket contact disposed in the at least one cavity, the socket contact having a contact section which is adapted for mating with a corresponding pin contact of the receptacle connector; the contact section having an end face which is recessed from the mating face;

a first dielectric member disposed in the cavity between the mating face and the end face and extending at least over the end face; and a second dielectric member disposed within the socket contact, the second dielectric member having post disposed in the contact section so as to define a gap between the post and the inner surface of the contact section;

wherein inadvertent electrical engagement with the socket contact is prevented.

8. The plug connector according to claim 7, wherein the second dielectric member includes a base which is retained in the socket contact by a snap fit means.

* * * * *